US006272305B1

(12) United States Patent
Liu

(10) Patent No.: US 6,272,305 B1
(45) Date of Patent: Aug. 7, 2001

(54) APPARATUS FOR DEVELOPING A LATENT IMAGE

(75) Inventor: Chu-heng Liu, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/449,993

(22) Filed: Nov. 26, 1999

(51) Int. Cl.[7] ..... G03G 15/08
(52) U.S. Cl. ..... 399/266; 399/281
(58) Field of Search ..... 399/266, 272, 399/281

(56) References Cited

U.S. PATENT DOCUMENTS 4,777,106 10/1988 Fotland et al. ..... 430/120
5,532,100 7/1996 Christy et al. ..... 430/120
5,734,955 * 3/1998 Gruber et al. ..... 399/266
5,742,885 * 4/1998 Wayman ..... 399/266 X
5,950,057 * 9/1999 Erhardt et al. ..... 399/266

* cited by examiner

*Primary Examiner*—William J. Royer
(74) *Attorney, Agent, or Firm*—Lloyd F. Bean, II

(57) ABSTRACT

An apparatus for developing a latent image recorded on an imaging surface, including a housing defining a chamber storing a supply of toner; a donor member, spaced from the imaging surface, for transporting developer material on the surface thereof to a region opposed from the imaging surface, a transport member for transporting toner from said housing and loading toner onto the donor member, the transport member, further includes a mask layer adjacent to the photoconductive layer, the mask layer having a screen pattern; a charging device for charging the photoconductive layer and an exposure device for discharging unmasked portions of the transport member thereby generating the fringe field on the surface of the transport member to attract toner from the housing to the surface of the transport member.

11 Claims, 6 Drawing Sheets

APPARATUS FOR DEVELOPING A LATENT IMAGE

This invention relates generally to a development apparatus for ionographic or electrophotographic imaging and printing apparatuses and machines, and more particularly is directed to an apparatus and method for loading dry Xerographic toner onto a donor member and developing a latent electrostatic image.

BACKGROUND OF THE INVENTION

Generally, the process of electrophotographic printing includes charging a photoconductive member to a substantially uniform potential so as to sensitize the surface thereof. The charged portion of the photoconductive surface is exposed to a light image from either a scanning laser beam or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image on image processing, superimposes toner powder images of different color toners onto the photoreceptor prior to the transfer of the composite toner powder image onto the substrate. While image on image process is beneficial, it has several problems. For example, when recharging the photoreceptor in preparation for creating another color toner powder image, it is important to level the voltages between the previously toned and the untoned areas of the photoreceptor.

In the application of the toner to the latent electrostatic images contained on the charge-retentive surface, it is necessary to transport the toner from a developer housing to the surface. A basic limitation of conventional xerographic development systems, including both magnetic brush and single component, is the inability to deliver toner (i.e. charged pigment) to the latent images without creating large adhesive forces between the toner and the conveyor, which transport the toner to latent images. As will be appreciated, large fluctuation (i.e. noise) in the adhesive forces that cause the pigment to tenaciously adhere to the carrier, severely limit the sensitivity of the developer system, thereby necessitating higher contrast voltages forming the images. Accordingly, it is desirable to reduce such noise, particularly in connection with latent images formed by contrasting voltages.

Fluidized beds have been used to provide a means for storing, mixing and transporting toner in certain single component development systems and loading onto developer rolls. Efficient means for fluidizing toner and charging the particles within the fluidized bed are disclosed in U.S. Pat. No. 4,777,106 and U.S. Pat. No. 5,532,100, which are hereby incorporated by reference. In these disclosures, corona devices are embedded in the fluidized toner for simultaneous toner charging and deposition onto a receiver roll. While the development system as described has been found satisfactory in some development applications, it leaves something to be desired in the way applications requiring the blending of two or more dry powder toners to achieve custom color development. Also, it has been found in the above systems that there are frequently disturbances to the flow in the fluidized bed associated with charged particles in the high electric fields surrounding corona devices immersed in the reservoir. Also, wire contamination presents a reliability issue.

Triboelectric charging (contact electrification) of dry toners is a standard method used to electrically charge toner particles for development of latent electrostatic images. An alternate method to charge toners is via ion bombardment (Ion Charging) which offers many advantages, especially in applications to custom color where "in-situ" toner mixing is advantageous. Triboelectric charging of colored toners requires different additives dependent on toner color to achieve stable charging, whereas ion charging of toners offers the advantage of charging toner particles based mainly on their size, independent of their intrinsic composition and surface structure. Triboelectric charging of toners also can create localized patches of charge on the toner particles which can lead to strong adhesion of these toners to various surfaces requiring special measures to remove them in the development, transfer and cleaning steps in the xerographic process. In the ion charging process, charged ions bombarding the toner particles are driven by the net field around the particles which tends to uniformly charge the toner, helping to decrease adhesion of these toners to donor or photoreceptor surfaces. One method to charge toner via ion bombardment involves fluidizing the toner and charging it using corona generation in close proximity to this fluidized bed.

However, noting the issues above the achievement of high reliability and simple, economic manufacturability of the system continue to present problems.

SUMMARY OF THE INVENTION

Briefly, the present invention obviates the problems noted above by utilizing an apparatus for loading and charging toner and developing an image. An apparatus for developing a latent image recorded on an imaging surface, including a housing, defining a chamber, storing a supply of toner; a donor member, spaced from the imaging surface, for transporting developer material on the surface thereof, to a region opposed from the imaging surface, a transport member for transporting toner from said housing and loading toner onto said donor member, said transport member further includes a surface with uniformly distributed, high density fringe fields, to pickup and transport a toner layer and a corona device to ionicly charge the toner on said fringe field surface.

In accordance with another aspect of this invention, the transport member further includes a mask layer adjacent to a photoconductive layer, said mask layer having a screen pattern; a charging device for charging said photoconductive layer and an exposure device for discharging unmasked portions of said transport member thereby generating said fringe field on the surface of the transport member to attract toner from said housing to the surface of the transport member.

Inasmuch as the art of electrophotographic printing is well known, the various processing stations employed in the printing machine will be shown hereinafter schematically and their operation described briefly with reference thereto.

DETAILED DESCRIPTION OF THE INVENTION

Figure 1:
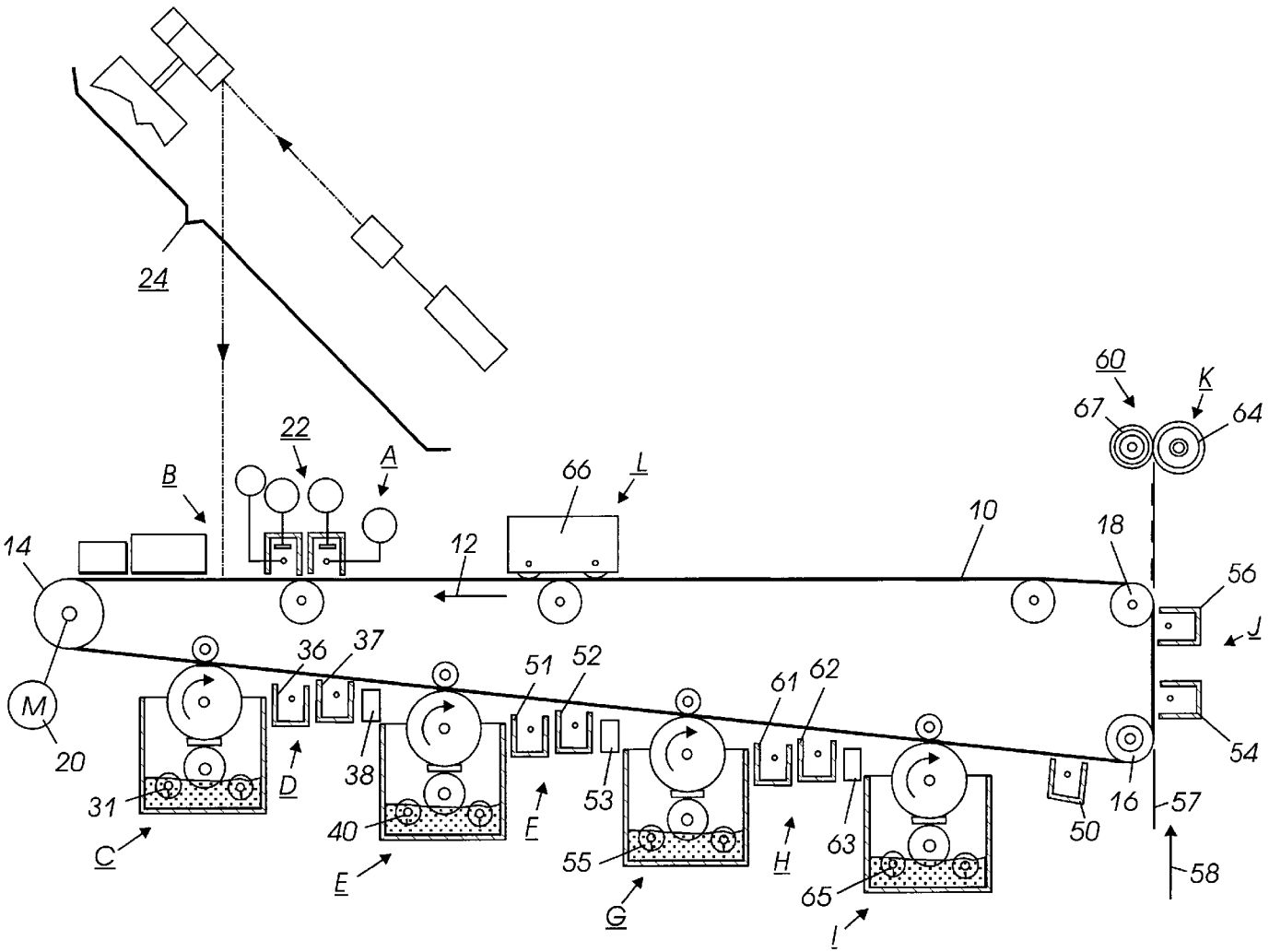
FIG. 1 is a schematic elevational view of an illustrative electrophotographic printing or imaging machine or apparatus, incorporating a development apparatus having the features of the present invention therein.

Referring initially to FIG. 1, there is shown an illustrative electrophotographic machine having incorporated therein the development apparatus of the present invention. An electrophotographic printing machine creates a color image in a single pass through the machine and incorporates the features of the present invention. The printing machine uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images that, after being transferred to a substrate, produce the final image. While the photoreceptor belt may have numerous image areas, since each image area is processed in the same way, a description of the typical processing of one image area suffices to fully explain the operation of the printing machine.

Figure 2:
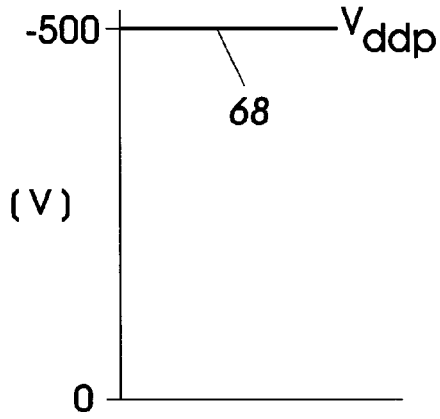
FIG. 2 shows a typical voltage profile of an image area in the electrophotographic printing machines illustrated in FIG. 1 after that image area has been charged.

As the photoreceptor belt 10 moves, the image area passes through a charging station A. At charging station A, a corona generating device, indicated generally by the reference numeral 22, charges the image area to a relatively high and substantially uniform potential. FIG. 2 illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2 shows the image area as being negatively charged, it could be positively charged if the charge levels and polarities of the toners, recharging devices, photoreceptor, and other relevant regions or devices are appropriately charged.

Figure 3:
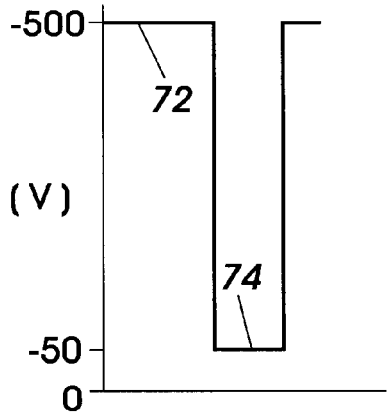
FIG. 3 shows a typical voltage profile of the image area after being exposed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser-based output scanning device 24 as a light source, it is to be understood that other light sources, for example an LED printbar, can also be used with the principles of the present invention. FIG. 3 shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development station E, G, and I. The first development station C deposits a first color, say black, of negatively charged toner 31 onto the image area. That toner is attracted to the less negative sections of the image area and repelled by the more negative sections. The result is a first toner powder image on the image area. It should be understood that one could also use positively charged toner if the exposed and unexposed areas of the photoreceptor are interchanged, or if the charging polarity of the photoreceptor is made positive.

Figure 8:
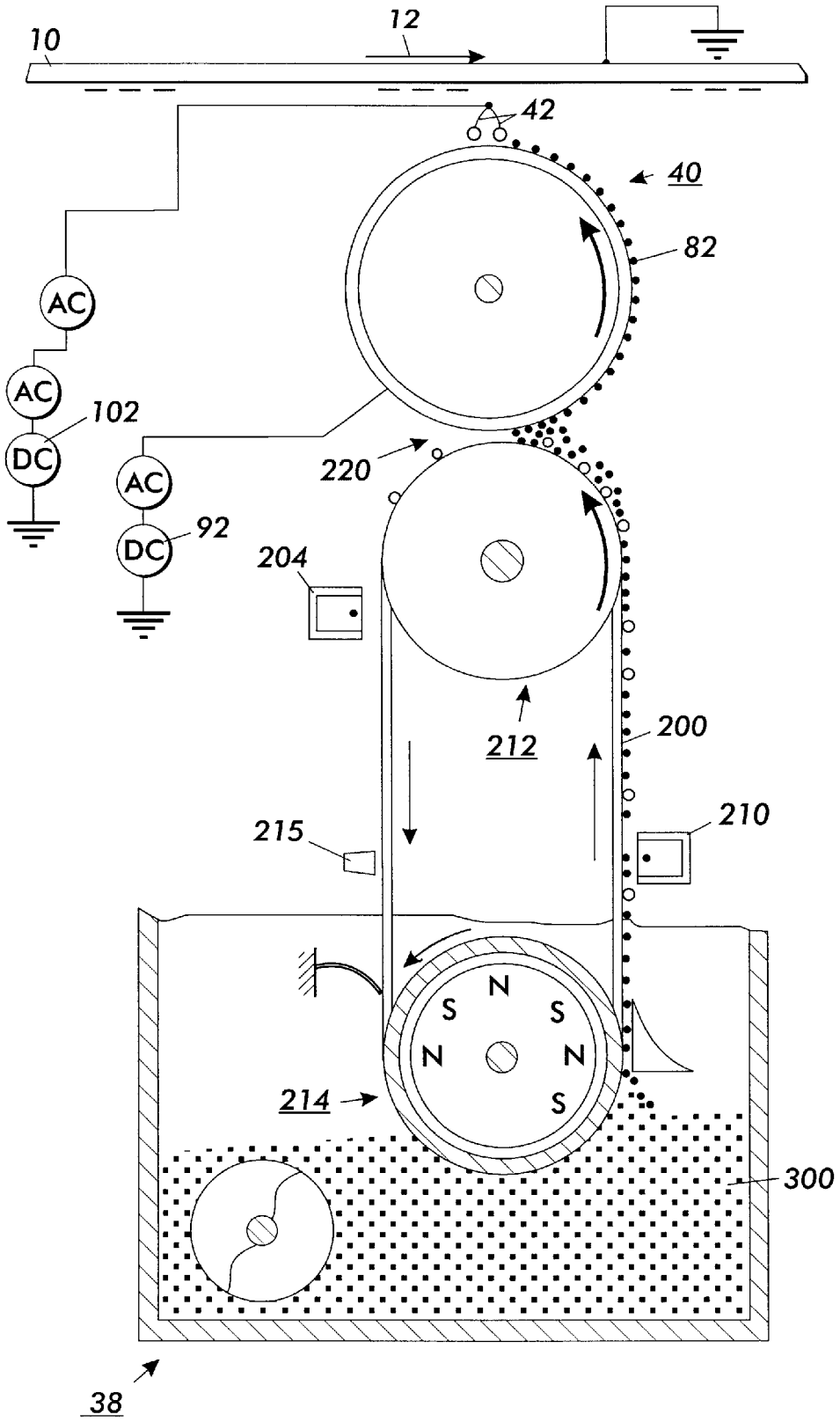
FIG. 8 is a schematic elevational view showing the development apparatus used in the FIG. 1 printing machine.

The first development station C includes a donor roll. As illustrated in FIG. 8, electrode grid 42 is electrically biased with an AC voltage relative to donor roll 40 for the purpose of detaching toner therefrom. This detached toner forms a toner powder cloud in the gap between the donor roll and photoconductive surface. Both electrode grid 42 and donor roll 40 are biased with DC sources 102 and 92 respectively for discharge area development (DAD). The discharged photoreceptor image attracts toner particles from the toner powder cloud to form a toner powder image thereon.

Figure 4:
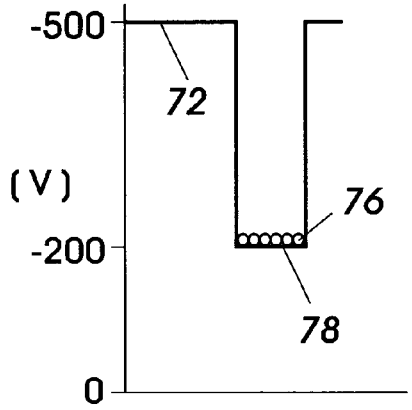
FIG. 4 shows a typical voltage profile of the image area after being developed.

FIG. 4 shows the voltages on the image area after the image area passes through the first development station C. Toner 76 (which generally represents any color of toner) adheres to the illuminated image area. This causes the voltage in the illuminated area to increase to, for example, about −200 volts, as represented by the solid line 78. The unilluminated parts of the image area remain at about the level −500.

Referring back to FIG. 1, after passing through the first development station C, the now exposed and toned image area passes to a first recharging station D. The recharging station D is comprised of two corona recharging devices, a first recharging device 36 and a second recharging device 37. These devices act together to recharge the voltage levels of both the toned and untoned parts of the image area to a substantially uniform level. It is to be understood that power supplies are coupled to the first and second recharging devices 36 and 37, and to any grid or other voltage control surface associated therewith, so that the necessary electrical inputs are available for the recharging devices to accomplish their task.

Figure 5:
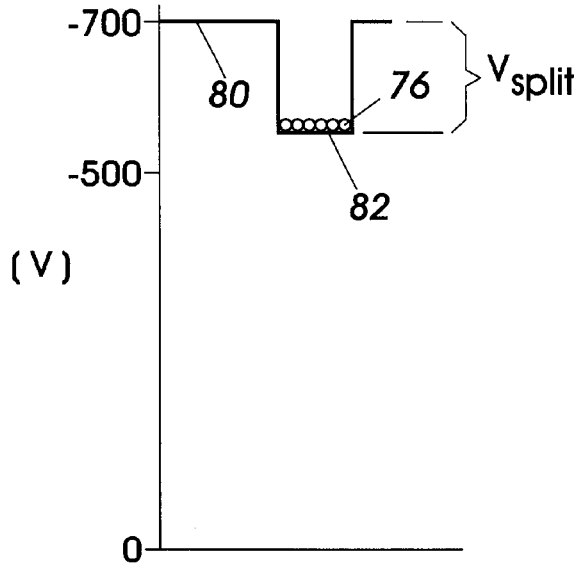
FIG. 5 shows a typical voltage profile of the image area after being recharged by a first recharging device.

FIG. 5 shows the voltages on the image area after it passes through the first recharging device 36. The first recharging device overcharges the image area to more negative levels than that which the image area is to have when it leaves the recharging station D. For example, as shown in FIG. 5, the toned and the untoned parts of the image area reach a voltage level 80 of about −700 volts. The first recharging device 36 is preferably a DC scorotron.

After being recharged by the first recharging device 36, the image area passes to the second recharging device 37.

Figure 6:
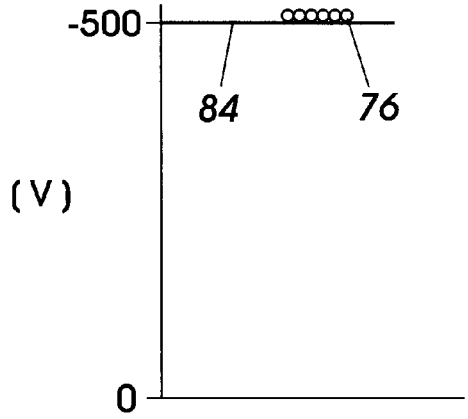
FIG. 6 shows a typical voltage profile of the image area after being recharged by a second recharging device.

Referring now to FIG. 6, the second recharging device 37 reduces the voltage of the image area, both the untoned parts and the toned parts (represented by toner 76) to a level 84 which is the desired potential of −500 volts.

Figure 7:
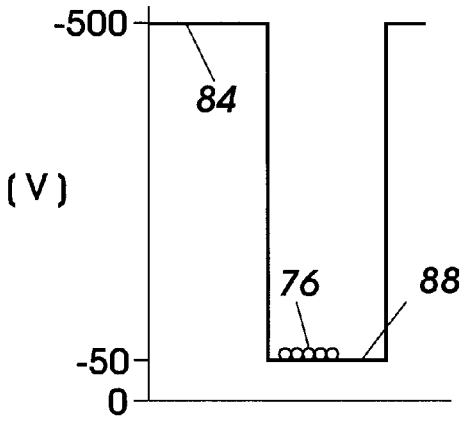
FIG. 7 shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 7 illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner 40 which is of a different color (yellow) than the toner 31 (black) in the first development station C, the second development station is substantially the same as the first development station. Since the toner 40 is attracted to the less negative parts of the image area and repelled by the more negative parts, after passing through the second development station E, the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner 55 (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner 65 (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 57 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 57. This causes the negatively charged toner powder images to move onto the support sheet 57. The transfer station J also includes a detack corona device 56 which facilitates the removal of the support sheet 57 from the printing machine.

After transfer, the support sheet 57 moves onto a conveyor (not shown) which advances that sheet to a fusing station K. The fusing station K includes a fuser assembly, indicated generally by the reference numeral 60, which permanently affixes the transferred powder image to the support sheet 57. Preferably, the fuser assembly 60 includes a heated fuser roller 67 and a backup or pressure roller 64. When the support sheet 57 passes between the fuser roller 67 and the backup roller 64 the toner powder is permanently affixed to the support sheet 57. After fusing, a chute, not shown, guides the support sheet 57 to a catch tray, also not shown, for removal by an operator.

After the support sheet 57 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Referring now to FIG. 8 in greater detail, development station 38 includes a donor roll 40. A development apparatus advances developer materials into development zones. The development station 38 is scavengeless. By scavengeless is meant that the developer or toner of station 38 must not interact with an image already formed on the image receiver. Thus, the station 38 is also known as a non-interactive development station. The development station 38 comprises a donor structure in the form of a roll 40. The donor structure 40 conveys a toner layer to the development zone which is the area between the photoreceptor belt 10 and the donor structure 40. The toner layer 82 can be formed on the donor structure 40 by either a two-component developer (i.e. toner and carrier), as shown in FIG. 8, or a single-component developer deposited on donor structure 40 via a combination single-component toner metering and charging device. The development zone contains an AC biased electrode grid 90 self-spaced from the donor roll 40 by the toner layer. The single-component toner may comprise positively or negatively charged toner. The electrode grid 42 may be coated with TEFLON-S (trademark of E. I. DuPont De Nemours) loaded with carbon black.

Figure 9:
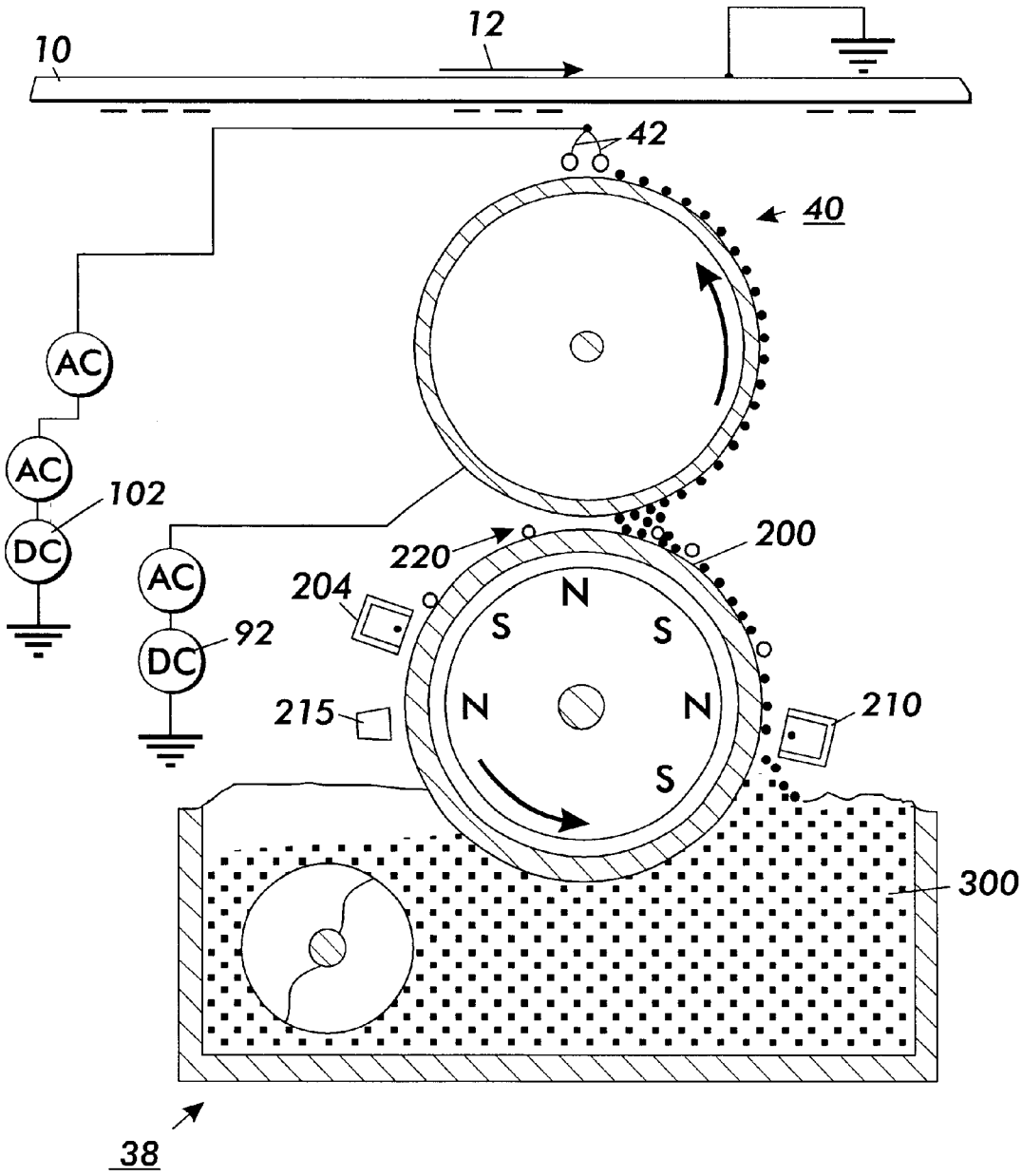
Figure 10:
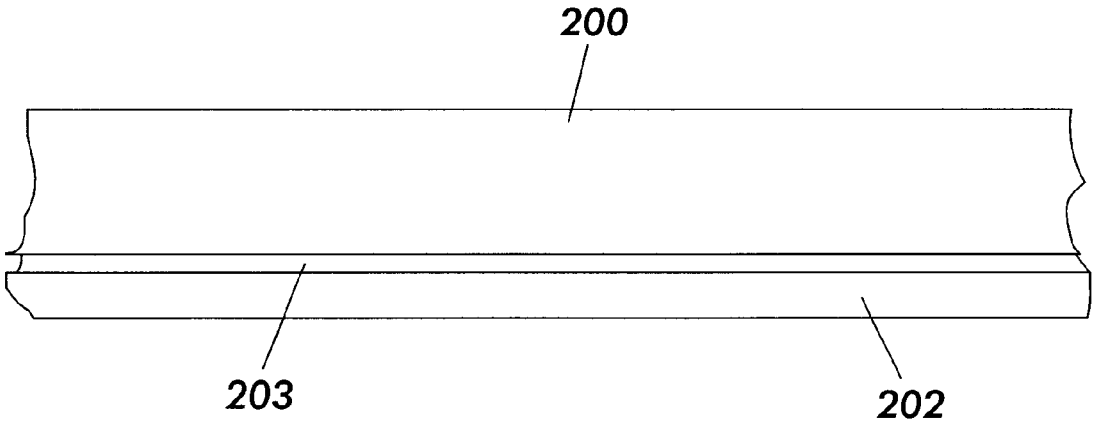

For donor roll, loading with developer material is accomplished by the present invention. Transport member 200 in FIG. 8 is shown as a belt or can take the form of a drum as shown in FIG. 9. The transport member is charged by charging device 204. Transport member 200 as shown in FIG. 10 is a schematic Active Matrix (AMAT) photoreceptor belt having a mask screen pattern 203 therein. Mask screen pattern 203 can be a fine line pattern or a random pattern.

The transport member can take form as a belt entrained about roller 212 and 214 as shown in FIG. 8 or a drum as shown in FIG. 9.

Transport member 200 is then exposed by a flood exposure device 215 which creates voltage differences on the surface of the transport member resulting in a fringe electric field pattern being generated on the surface of the transport member 200. The flood exposure can be from the inside of the belt or outside the belt. Preferably, the resultant fringe electric field pattern has a contrast greater than 100 Volts. Transport member 200 travels through a toner bed 300. The toner bed can be fluidized if desired by an air plenum (not shown). Toner is attracted to the surface of transport member 200 by the fringe field and a toner layer is formed thereon. Preferably, the toner layer has a thickness between 10 to 200 □m. Thereafter, the toner is ion charged by charging device 210. Preferably, the toner layer is charged to about 10 to 100 □C/g. Next, the layer of toner is transferred to donor roll 40.

Let's focus on the toner pickup and toner layer formation process. Fringe lines are the boundaries between areas with high and low voltages. Fringe fields exist along the fringe lines, The fields originate from the high voltage side of the fringe line and end on the low voltage side. The fringe fields are typically very strong due to a high voltage drop across a short distance and is spatially localized only in the neighborhood of the fringe lines. Because of its bi-directional nature (fields are in opposite directions on the high/low voltage sides), it can pickup toner of both polarities. Also due to its strong spatial gradient (fields decay away from the fringe area quickly), it can also pickup neutral toner due to polarization effect. According to the present invention, a surface with uniformly distributed high density fringe lines is used to load toner materials. The density of the boundary lines should be greater than 5 $mm/mm^2$ for uniform and effective toner loading. In a further preferred embodiment, the density is higher than 20 $mm/mm^2$. The pattern can be regular patterns such as lines and dots or randomly but uniformly distributed fringe lines.

An advantageous feature of the present invention is that the fringe fields can pick up both charge toner and neutral toner. Further, the charging characteristics of the transport member can be modified so that the desired rate (i.e. rotation speed of transport member) of loading of donor roll 40 and discharging rate of transport member 200 can be matched so that the fringe fields are minimized or zero at reload zone 220.

Other embodiments of transport member 200 could take the form wherein the fringe field patterns are burned in the fringe field surface structure. As one preferred embodiment, the surface layer of the transport member has a fixed spatial conductivity pattern which consists of more conductive and less conductive regions so that when the transport member is charged, the more conductive regions discharge soon thereafter thereby causing a fringe field pattern to be generated on the surface of the transport member. The more conductive region can be conductive or semiconductive and the less conductive region can be semiconductive or insulative. Alternatively, the transport member can be made by doping of a photoconductive layer to create a conductivity pattern so that when the transport member is charged, the more conductive pattern discharges to a lower potential thereby causing fringe fields to be generated on the surface of the transport member.

Other embodiments and modifications of the present invention may occur to those skilled in the art subsequent to a review of the information presented herein; these embodiments and modifications, as well as equivalents thereof, are also included within the scope of this invention.

What is claimed is:

1. An apparatus for developing a latent image recorded on an imaging surface, comprising:

a housing defining a chamber storing a supply of toner;

a donor member, spaced from the imaging surface, for transporting developer material on the surface thereof to a region opposed from the imaging surface, a transport member for transporting toner from said housing and loading toner onto said donor member, and means for generating a fringe field on the surface of said transport member to attract toner from said housing to the surface of the transport member.

2. The apparatus of claim 1, wherein said transport member includes a photoconductive layer.

3. The apparatus of claim 2, wherein said transport member further includes a mask layer adjacent to said photoconductive layer, said mask layer having a screen pattern.

4. The apparatus of claim 3, wherein said generating means includes a charging device for charging said photoconductive layer and an exposure device for discharging unmasked portions of said transport member thereby generating said fringe field on the surface of the transport member.

5. The apparatus of claim 2, wherein said generating means includes a charging device for charging said photoconductive layer, said photoconductive layer being conductive doped in a screen pattern for discharging portions of the surface of said transport member after being charged thereby generating said fringe field on the surface of the transport member.

6. The apparatus of claim 1, wherein said transport member includes a layer with more conductive and less conductive regions forming a uniform pattern.

7. The apparatus of claim 1, further comprising an ion charging device for ion charging toner on said transport member.

8. The apparatus of claim 2, wherein said photoconductive layer on said transport member is substantially discharged when toned portions thereof reach a reload area between said donor member and said transport member.

9. The apparatus of claim 1, wherein said transport member is a belt.

10. The apparatus of claim 1, wherein said transport member is a roll.

11. The apparatus of claim 1, wherein toner is fluidized in said housing.

* * * * *